US008741401B2

(12) United States Patent
Noguchi et al.

(10) Patent No.: US 8,741,401 B2
(45) Date of Patent: Jun. 3, 2014

(54) RECORDING MEDIUM

(75) Inventors: Tetsuro Noguchi, Hachioji (JP); Hisao Kamo, Ushiku (JP); Yasuhiro Nito, Yokohama (JP); Ryo Taguri, Sagamihara (JP); Isamu Oguri, Yokohama (JP); Olivia Herlambang, Kawasaki (JP); Naoya Hatta, Kawasaki (JP); Shinya Yumoto, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 165 days.

(21) Appl. No.: 13/368,242

(22) Filed: Feb. 7, 2012

(65) Prior Publication Data

US 2012/0207949 A1 Aug. 16, 2012

(30) Foreign Application Priority Data

Feb. 10, 2011 (JP) ..... 2011-027543

(51) Int. Cl.
*B41M 5/00* (2006.01)
*B41M 5/50* (2006.01)
*B41M 5/52* (2006.01)

(52) U.S. Cl.
CPC ..... *B41M 5/508* (2013.01); *B41M 5/52* (2013.01); *B41M 5/5218* (2013.01); *B41M 5/506* (2013.01); *B41M 5/5254* (2013.01)
USPC ..... 428/32.18; 428/32.24; 428/32.25; 428/32.26; 428/32.28; 428/32.34

(58) Field of Classification Search
CPC ..... B41M 5/508; B41M 5/52; B41M 5/5218; B41M 5/506; B41M 5/5254
USPC ..... 428/32.18, 32.24, 32.25, 32.26, 32.28, 428/32.34
See application file for complete search history.

(56) References Cited

U.S. PATENT DOCUMENTS

| | | | | |
|---|---|---|---|---|
| 4,202,870 | A | 5/1980 | Caglione et al. | |
| 4,242,271 | A | 12/1980 | Hill et al. | |
| 6,387,473 | B1 * | 5/2002 | Sismondi et al. | 428/32.34 |
| 2001/0004487 | A1 * | 6/2001 | Kaneko et al. | 428/195 |
| 2003/0049420 | A1 * | 3/2003 | Inoue et al. | 428/195 |
| 2003/0072925 | A1 * | 4/2003 | Kiyama et al. | 428/195 |
| 2003/0081103 | A1 * | 5/2003 | Ishimaru et al. | 347/105 |
| 2009/0011155 | A1 * | 1/2009 | Kamo et al. | 428/32.25 |
| 2012/0207949 | A1 * | 8/2012 | Noguchi et al. | 428/32.25 |

FOREIGN PATENT DOCUMENTS

| | | | |
|---|---|---|---|
| CN | 1394170 | A | 1/2003 |
| EP | 1329330 | A1 | 7/2003 |
| EP | 2141024 | A1 | 1/2010 |
| JP | 5-16015 | B2 | 3/1993 |
| JP | 7-232473 | A | 9/1995 |
| JP | 8-132731 | A | 5/1996 |
| JP | 9-66664 | A | 3/1997 |
| JP | 9-76628 | A | 3/1997 |
| JP | 2004-1528 | A | 1/2004 |
| JP | 2010-280201 | A | 12/2010 |

* cited by examiner

*Primary Examiner* — Betelhem Shewareged
(74) *Attorney, Agent, or Firm* — Canon U.S.A., Inc., IP Division

(57) ABSTRACT

A recording medium includes a support; and an ink-receiving layer, the ink-receiving layer having a lower layer and an upper layer, in which the lower layer contains fine inorganic particles, polyvinyl alcohol, and boric acid, the fine inorganic particles including at least one compound selected from alumina, hydrated alumina, and vapor-phase-process silica, in which the upper layer contains fine inorganic particles, polyvinyl alcohol, and boric acid, the fine inorganic particles including at least one compound selected from alumina and hydrated alumina, in which the lower layer has a boric acid content of 2.0% by mass to 7.0% by mass with respect to polyvinyl alcohol, and in which the upper layer has a boric acid content of 10.0% by mass to 30.0% by mass with respect to polyvinyl alcohol.

7 Claims, No Drawings

RECORDING MEDIUM

BACKGROUND OF THE INVENTION

1. Field of the Invention

The present invention relates to a recording medium.

2. Description of the Related Art

Known examples of recording media in which recording is performed with ink include recording media each including an ink-receiving layer on a support. Recent trends toward higher recording speed have required recording media having higher ink absorbency.

Japanese Patent Laid-Open No. 2004-1528 discloses a recording medium including an upper layer and a lower layer on a support. In the recording medium, a binder-to-pigment ratio is increased with increasing distance from the upper layer toward the lower layer, thereby providing high ink absorbency, high adhesion between the support and the ink-receiving layers, and inhibiting the occurrence of cracking of the ink-receiving layer after coating.

SUMMARY OF THE INVENTION

According to one aspect of the present invention, a recording medium is provided including a support and an ink-receiving layer provided on the support, the ink-receiving layer having a lower layer and an upper layer, in which the lower layer contains fine inorganic particles, polyvinyl alcohol, and boric acid, the fine inorganic particles including at least one compound selected from alumina, hydrated alumina, and vapor-phase-process silica, in which the upper layer contains fine inorganic particles, polyvinyl alcohol, and boric acid, the fine inorganic particles including at least one compound selected from alumina and hydrated alumina, in which the lower layer has a boric acid content of 2.0% by mass to 7.0% by mass with respect to polyvinyl alcohol, and in which the upper layer has a boric acid content of 10.0% by mass to 30.0% by mass with respect to polyvinyl alcohol.

Further features of the present invention will become apparent from the following description of exemplary embodiments.

DESCRIPTION OF THE EMBODIMENTS

A recording medium according to aspects of the present invention will be described in detail below.

In recent years, on-demand photograph collections including preferable photographs or photographs mixed with text, i.e., photo books and photo albums in which images are provided on both surfaces of each sheet, have been produced. In such a case, the following bookbinding process may sometimes be employed: A crease is made in a recording medium in which an image is recorded on only one surface. The recording medium is folded along the crease. Back surfaces of two sheets of the recording media are bonded to each other, and then binding is performed. In the bookbinding process, a double-page spread centered on the crease may be used. It is thus possible to arrange a large-sized photograph or image extending from one page to a subsequent page to form high-quality photo books and photo albums, compared with usual bookbinding. In the case where such photo books and photo albums that may use a double-page spread are bound, if an ink-receiving layer is cracked or is partially detached in the creased portion, the appearance of an image may be reduced. So, the recording medium is required to have high resistance to cracking by folding.

However, it has been found from studies by the present inventors that the recording medium disclosed in, for example, Japanese Patent Laid-Open No. 2004-1528 does not have sufficient resistance to cracking by folding.

Accordingly, aspects of the present invention can provide a recording medium that has high ink absorbency, inhibits the occurrence of cracking after coating, and has high resistance to cracking by folding.

The recording medium according to aspects of the present invention includes a support and an ink-receiving layer provided on the support, the ink-receiving layer having two layers: a lower layer and an upper layer. The support and the lower layer are adjacent to each other. A surface of the lower layer opposite the surface adjacent to the support is adjacent to the upper layer.

Support

In aspects of the present invention, a water resistant support may be used as the support. Examples of the water resistant support include resin-coated paper in which a base paper is coated with a resin, synthetic paper, and plastic films. In particular, resin-coated paper may be used as the water resistant support.

An example of the base paper of resin-coated paper that may be used is plain paper commonly used. Smooth base paper used as a photographic support may be used. In particular, base paper which has been subjected to surface treatment in which compression is performed under pressure with, for example, a calender during papermaking or after papermaking and which has high surface smoothness may be used. Examples of a pulp constituting base paper include natural pulp, recycled pulp, and synthetic pulp. These pulps may be used separately or in combination as a mixture of two or more. The base paper may contain additives, such as a sizing agent, a paper-strengthening agent, a filler, an antistatic agent, a fluorescent whitener, and a dye, which are commonly used in papermaking. Furthermore, the base paper may be coated with, a surface-sizing agent, a surface-strengthening agent, a fluorescent whitener, an antistatic agent, a dye, and an anchoring agent. The base paper may have a density of 0.6 g/cm$^3$ to 1.2 g/cm$^3$ and even 0.7 g/cm$^3$ or more. A density of 1.2 g/cm$^3$ or less results in the inhibition of reduction in cushioning properties and transport properties. A density of 0.6 g/cm$^3$ or more results in the inhibition of a reduction in surface smoothness. The base paper may have a thickness of 50.0 μm or more. A thickness of 50.0 μm or more results in improvements in tensile strength, tear strength, and texture. The base paper may have a thickness of 350.0 μm or less in view of productivity and so forth. The thickness of the resin (resin layer) with which the base paper is coated may be 5.0 μm or more such as 8.0 μm or more, and may be 40.0 μm or less such as 35.0 μm or less. A thickness of 5.0 μm or more results in the inhibition of the penetration of water and gas into the base paper and the inhibition of cracking of the ink-receiving layer by folding. A thickness of 40.0 μm or less results in improvement in anticurl properties. Examples of the resin that may be used include low-density polyethylene (LDPE) and high-density polyethylene (HDPE). In addition, linear low-density polyethylene (LLDPE) and polypropylene may be used. In particular, for a resin layer located on the side (surface side) where the ink-receiving layer is formed, rutile or anatase titanium oxide, a fluorescent whitener, and ultramarine blue may be added to polyethylene to improve opacity, brightness, and hues. In the case where the resin layer contains titanium oxide, the titanium oxide content is may be 3.0% by mass or more such as 4.0% by mass or more, and may be 20.0% by mass or less such as 13.0% by mass or less with respect to the total mass of the resin.

Examples of the plastic film include films produced from thermoplastic resins, such as polyethylene, polypropylene, polystyrene, polyvinyl chloride, and polyester, and thermosetting resins, such as urea resins, melamine resins, and phenolic resins. The plastic film may have a thickness of 50.0 μm to 250.0 μm.

The water resistant support may have a desired surface state, such as a glossy surface, a semi-glossy surface, and a matt surface. In particular, the semi-glossy surface and the matt surface may be used. For example, when a resin is melt-extruded onto a surface of base paper to perform coating, embossing may be performed by bringing the surface of the resin into pressure contact with a roller having a patterned surface with irregularities to form the semi-glossy surface or the matt surface. In the case where the ink-receiving layer is formed on the support having the semi-glossy surface or the matt surface, irregularities reflecting the irregularities of the support are formed on a surface of the ink-receiving layer, i.e., on a surface of the recording medium. This inhibits glare due to excessively high gloss. The bonding area between the support and the ink-receiving layer is large, thus improving resistance to cracking by folding. The arithmetical mean roughness (Ra), complying with JIS B0601:2001, of the surface of the recording medium at a cutoff length of 0.8 mm may be in the range of 0.3 μm to 6.0 μm such as 0.5 μm to 3.0 μm. An arithmetical mean roughness of 0.3 μm to 6.0 μm results in satisfactory gloss.

In aspects of the present invention, a primer layer mainly composed of a hydrophilic polymer, e.g., gelatin or polyvinyl alcohol, may be formed on the surface of the support where the ink-receiving layer is formed. Alternatively, adhesion-improving treatment, e.g., corona discharge or plasma treatment, may be performed. So, the adhesion between the support and the ink-receiving layer may be improved.

Ink-Receiving Layer

The ink-receiving layer according to aspects of the present invention includes two layers: the lower layer and the upper layer. The ink-receiving layer is a solidified product of a coating liquid configured to form an ink-receiving layer (hereinafter, referred to as an "ink-receiving layer coating liquid"). The ink-receiving layer is formed by applying the ink-receiving layer coating liquid onto the water resistant support and drying the coating. The thickness of the ink-receiving layer is the total thickness of the upper layer and the lower layer and may be 15.0 μm or more, such as 20.0 μm or more, and even 25 μm or more, and may be 50.0 μm or less such as 40.0 μm or less. A thickness of the ink-receiving layer of 15.0 μm to 50.0 μm results in a satisfactory image density, ink absorbency, and resistance to cracking by folding, satisfactory. In aspects of the present invention, the ink-receiving layer may have a thickness of 30.0 μm to 38.0 μm.

With respect to the ink-receiving layer including the two layers, the lower layer contains fine inorganic particles, polyvinyl alcohol, and boric acid, the fine inorganic particles comprising at least one compound selected from alumina, hydrated alumina, and vapor-phase-process silica. The upper layer contains fine inorganic particles, polyvinyl alcohol, and boric acid, the fine inorganic particles comprising at least one compound selected from alumina and hydrated alumina. These components will be described below.

Alumina

Examples of alumina include γ-alumina, α-alumina, δ-alumina, θ-alumina, and χ-alumina. In particular, γ-alumina may be used from the viewpoint of achieving a good image density and ink absorbency. An example of γ-alumina is commercially available γ-alumina produced by a vapor-phase process (e.g., trade name: AEROXIDE Alu C, manufactured by EVONIK Industries).

Hydrated Alumina

Hydrated alumina represented by general formula (X) may be used:

$$Al_2O_{3-n}(OH)_{2n}.mH_2O \quad (X)$$

wherein n represents 0, 1, 2, or 3, m represents a value of 0 to 10 such as 0 to 5, with the proviso that m and n are not zero at the same time, m may represent an integer value or not an integer value because $mH_2O$ often represents detachable water that does not participate in the formation of a crystal lattice, and m may reach zero when the hydrated alumina is heated.

Known crystal structures of hydrated alumina include amorphous, gibbsite, and boehmite, depending on heat-treatment temperature. Hydrated alumina having any of these crystal structures may be used. In particular, hydrated alumina having a boehmite structure or an amorphous structure determined by X-ray diffraction analysis may be used. Specific examples of hydrated alumina include hydrated alumina described in, for example, Japanese Patent Laid-Open Nos. 7-232473, 8-132731, 9-66664, and 9-76628. Specific examples of the shape of hydrated alumina used in aspects of the present invention include indefinite shapes; and definite shapes, such as spherical and plate-like shapes. Any of the indefinite shapes and the definite shapes may be used. Alternatively, they may be used in combination. In particular, hydrated alumina whose primary particles have a number-average particle size of 5 nm to 50 nm may be used. Plate-like hydrated alumina having an aspect ratio of 2 or more may be used. The aspect ratio may be determined by a method described in Japanese Patent Publication No. 5-16015. That is, the aspect ratio is expressed as the ratio of the diameter to the thickness of a particle. The term "diameter" used here indicates the diameter (circle-equivalent diameter) of a circle having an area equal to the projected area of each hydrated alumina particle when the hydrated alumina is observed with a microscope or an electron microscope.

Hydrated alumina may have a BET specific surface area of 100 $m^2/g$ to 200 $m^2/g$ such as 125 $m^2/g$ to 190 $m^2/g$. A BET method is a method for measuring the surface area of a powder using a gas-phase adsorption technique and is a method for determining the total surface area of 1 g of a sample, i.e., a specific surface area, from an adsorption isotherm. In the BET method, nitrogen gas is commonly used as a gas to be adsorbed. A method in which the amount of the gas adsorbed is measured on the basis of a change in the pressure or volume of the gas adsorbed is most often employed. The most famous equation that indicates a multimolecular adsorption isotherm is the Brunauer-Emmett-Teller equation, which is referred to as the BET equation widely used in specific surface area determination. In the BET method, the amount of adsorbate is determined on the basis of the BET equation and is then multiplied by the area occupied by one adsorbate molecule on a surface to determine the specific surface area. In the BET method, in the case of the measurement of the nitrogen adsorption-desorption method, the amounts of adsorbate at several relative pressures are measured to calculate the gradient and intercept of the plot by the method of least squares, thereby determining the specific surface area. According to aspects of the present invention, the amounts of adsorbate adsorbed are measured at five different relative pressures to determine the specific surface area.

Hydrated alumina may be produced by a known method, for example, a method in which an aluminum alkoxide is hydrolyzed or a method in which sodium aluminate is hydrolyzed, as described in U.S. Pat. Nos. 4,242,271 and 4,202,870. Alternatively, hydrated alumina may also be produced by a known method, for example, a method in which an aqueous solution of sodium aluminate is neutralized by the addition of an aqueous solution of aluminum sulfate, aluminum chloride, or the like. Specific examples of hydrated alumina used in aspects of the present invention include hydrated alumina having a boehmite structure and amorphous structure, which are determined by X-ray diffraction analysis. In particular, examples thereof include hydrated alumina described in Japanese Patent Laid-Open Nos. 7-232473, 8-132731, 9-66664, and 9-76628. Furthermore, a specific example of hydrated alumina is commercially available hydrated alumina (for example, trade name: DISPERAL HP14, manufactured by Sasol).

Alumina and hydrated alumina may be used in combination as a mixture. In the case of mixing of alumina and hydrated alumina, powdery alumina and powdery hydrated alumina may be mixed and dispersed to prepare a dispersion (sol). Alternatively, an alumina dispersion and a hydrated alumina dispersion may be mixed.

Silica Produced by Vapor-Phase Process

Silica produced by a vapor-phase process indicates silica produced by the combustion of silicon tetrachloride, hydrogen, and oxygen, and is also referred to as dry process silica. An example of silica produced by a vapor-phase process is commercially available silica produced by a vapor-phase process (e.g., trade name: AEROSIL 300, manufactured by EVONIK industries).

Silica produced by a vapor-phase process may have a BET specific surface area of 50 $m^2/g$ or more such as 200 $m^2/g$ or more, and may have a BET specific surface area of 400 $m^2/g$ or less such as 350 $m^2/g$ or less from the viewpoint of achieving good ink absorbency, image density, and resistance to cracking during coating and drying. The BET specific surface area is determined in the same way as hydrated alumina described above.

Polyvinyl Alcohol

An example of the polyvinyl alcohol is a common polyvinyl alcohol produced by hydrolysis of polyvinyl acetate. The polyvinyl alcohol may have a viscosity-average polymerization degree of 2000 to 4500 and such as 3000 to 4000. A viscosity-average polymerization degree of 2000 to 4500 results in improvements in ink absorbency, image density, and resistance to cracking by folding, and results in the inhibition of occurrence of cracking at the time of coating. The polyvinyl alcohol may be a partially or completely saponified polyvinyl alcohol. The polyvinyl alcohol may have a saponification degree of 85% by mole to 100% by mole. An example of the polyvinyl alcohol is PVA 235 (manufactured by Kuraray Co., Ltd., saponification degree: 88% by mole, average degree of polymerization: 3500).

In the case where the polyvinyl alcohol is incorporated into the ink-receiving layer coating liquid, the polyvinyl alcohol may be contained in an aqueous solution. An aqueous solution containing the polyvinyl alcohol may have a solid content of 4.0% by mass to 15.0% by mass in terms of polyvinyl alcohol. A solid content of 4.0% by mass to 15.0% by mass results in the inhibition of a significant reduction in drying rate due to an excessive reduction in the concentration of the coating liquid, and results in the inhibition of a decrease in smoothness due to a significant increase in the viscosity of the coating liquid caused by an increase in the concentration of the coating liquid.

The ink-receiving layer may contain a binder other than polyvinyl alcohol, as needed. To sufficiently provide advantageous effects of aspects of the present invention, the proportion of the binder other than polyvinyl alcohol may be 50.0% by mass or less with respect to the total mass of the polyvinyl alcohol.

Boric Acid

Examples of boric acid include orthoboric acid ($H_3BO_3$), metaboric acid, and hypoboric acid. These compounds may be used in the form of borates. Examples of borates include orthoborates, such as $InBO_3$, $ScBO_3$, $YBO_3$, $LaBO_3$, $Mg_3(BO_3)_2$, and $Co_3(BO_3)_2$); diborates, such as $Mg_2B_2O_5$ and $Co_2B_2O_5$; metaborates, such as $LiBO_2$, $Ca(BO_2)_2$, $NaBO_2$, and $KBO_2$); tetraborates, such as $Na_2B_4O_7.10H_2O$; pentaborates, such as $KB_5O_8.4H_2O$, $Ca_2B_6O_{11}.7H_2O$, and $CsB_5O_5$; and hydrates thereof. Among these borates, orthoboric acid may be used in view of the temporal stability of the coating liquid. In aspects of the present invention, the proportion of the orthoboric acid in the total mass of the boric acid may be in the range of 80% by mass to 100% by mass such as 90% by mass to 100% by mass.

In the case where the boric acid is incorporated into the ink-receiving layer coating liquid, the boric acid may be contained in an aqueous solution. An aqueous solution containing the boric acid may have a solid content of 0.5% by mass to 8.0% by mass. A solid content of 0.5% by mass to 8.0% by mass results in the inhibition of a significant reduction in drying rate due to a reduction in the concentration of the coating liquid, and results in the inhibition of the precipitation of boric acid.

Additive

Each of the upper layer and the lower layer may contain an additive. Examples of the additive include fixing agents, such as cationic resins; flocculants, such as multivalent metal salts; surfactants; fluorescent whiteners; thickeners; antifoaming agents: foam inhibitors; release agents; penetrants; lubricants, ultraviolet absorbers; antioxidants; leveling agents; preservatives; and pH regulators.

The relationship between the lower layer and the upper layer will be described below.

Relationship Between Upper Layer and Lower Layer

A traditional ink-receiving layer containing a cross-linking agent, such as boric acid, in addition to fine inorganic particles and polyvinyl alcohol contains a relatively large amount of the cross-linking agent. Thus, such an ink-receiving layer often has a high degree of cross-linking. In this case, cracking occurring during coating or drying (after coating) is likely to be effectively inhibited, thereby providing an ink-receiving layer having satisfactory ink absorbency. However, the resulting ink-receiving layer is hard and brittle because of its high degree of cross-linking, so that, in particular, the ink-receiving layer sometimes has low resistance to cracking by folding.

In the case where no cross-linking agent is contained, cracking occurring after coating is pronounced to reduce the ink absorbency. In addition, the resistance to cracking by folding, which is considered to be high because no cross-linking agent is contained, is sometimes low. The reason for this is not clear but is probably that in the case where none of the polyvinyl alcohol molecules is cross-linked, cohesive bonds among the polyvinyl alcohol, the fine inorganic particles, and water resistant support are weakened.

The inventors have conducted intensive studies and have found the following: The resistance to cracking by folding of the ink-receiving layer is affected by the adhesion between the water resistant support and the lower layer or between the lower layer and the upper layer. The resistance to cracking by folding of the ink-receiving layer is also affected by flexibility of the ink-receiving layer. When the polyvinyl alcohol in the upper layer and the lower layer adjacent to the water resistant support is cross-linked in a certain range, satisfactory resistance to cracking by folding is provided. There is the optimal cross-linking range of the polyvinyl alcohol from the viewpoint of achieving good resistance to cracking by folding. In this range, however, cracking after coating occurs, and the ink absorbency is reduced, in some cases. Accordingly, the inventors have found that the degree of cross-linking of each of the layers of the ink-receiving layer having the two layers are specified to increase the cracking resistance after coating, ink absorbency, and resistance to cracking by folding. This finding has led to the completion of aspects of the present invention.

In aspects of the present invention, the lower layer has a boric acid content of 2.0% by mass to 7.0% by mass with respect to polyvinyl alcohol. A boric acid content of 2.0% by mass to 7.0% by mass results in satisfactory contact between the water resistant support and the lower layer, thereby inhibiting the occurrence of cracking after coating and increasing the resistance to cracking by folding. The proportion of the boric acid in the lower layer may be in the range of 3.0% by mass to 6.5% by mass with respect to the amount of the polyvinyl alcohol.

The lower layer contains fine inorganic particles comprising at least one compound selected from alumina, hydrated alumina, and silica produced by a vapor-phase process. Hydrated alumina has a high surface density of hydroxy groups and high bonding strength to polyvinyl alcohol, compared with alumina and silica produced by a vapor-phase process. So, the proportion of hydrated alumina in the fine inorganic particles contained in the lower layer may be 50.0% by mass or more, such as 80% by mass, and even 100% by mass, in view of the resistance to cracking by folding.

The lower layer may have a polyvinyl alcohol content of 11.0% by mass to 40.0% by mass such as 12.0% by mass to 30.0% by mass with respect to the fine inorganic particles. A polyvinyl alcohol content of 11.0% by mass to 40.0% by mass results in the enhancement of the inhibition of cracking after coating and results in improvements in ink absorbency and resistance to cracking by folding.

The upper layer has a high boric acid content with respect to the polyvinyl alcohol content of the upper layer, compared with the lower layer. However, the boric acid content is not simply increased but may be set in the range of 10.0% by mass to 30.0% by mass with respect to polyvinyl alcohol. The upper layer with a boric acid content of 10.0% by mass to 30.0% by mass with respect to polyvinyl alcohol has an appropriately high degree of cross-linking of polyvinyl alcohol compared with the lower layer. Thus, even if ink droplets land, the polyvinyl alcohol is less likely to swell, thereby providing high ink absorbency. Furthermore, the resistance to cracking during coating or drying is improved. The upper layer may have a boric acid content of 12.0% by mass to 25.0% by mass with respect to the polyvinyl alcohol content of the upper layer.

The upper layer may have a polyvinyl alcohol content of 5.0% by mass to 10.0% by mass such as 6.0% by mass to 9.0% by mass with respect to the fine inorganic particles. A polyvinyl alcohol content of 5.0% by mass to 10.0% by mass results in the enhancement of the inhibition of cracking after coating and results in improvements in ink absorbency and resistance to cracking by folding, in combination with the structure of the lower layer. The upper layer contains fine inorganic particles comprising at least one compound selected from alumina and hydrated alumina. The total mass of alumina and hydrated alumina in the upper layer may be 90% by mass such as 100% by mass with respect to the total mass of the fine inorganic particles. The upper layer may contain the fine inorganic particles comprising both alumina and hydrated alumina. In the case where the upper layer contains the fine inorganic particles comprising both alumina and hydrated alumina, the ratio of alumina to hydrated alumina may be 60:40 to 80:20.

The upper layer may have a thickness of 5.0 μm to 20.0 μm such as 7.0 μm to 15.0 μm. The lower layer may have a thickness of 20.0 μm to 40.0 μm such as 20.0 μm to 28.0 μm. The thickness ratio of the upper layer to the upper layer, i.e., upper layer/lower layer, may be in the range of 0.08 to 1.0. A thickness ratio of 0.08 to 1.0 results in satisfactory resistance to cracking by folding, ink absorbency, and resistance to cracking during coating or drying.

While the ink-receiving layer according to aspects of the present invention has the two layers, a thin film may be provided on top of the upper layer, between the upper layer and the lower layer, or between the lower layer and the support as long as advantageous effects of aspects of the present invention are not significantly impaired. The thin film may have a thickness of 0.1 μm to 3.0 μm. In particular, a colloidal silica-containing surface layer serving as the thin film may be formed on the upper layer in view of glossiness and scratch resistance.

The term "thickness" used in aspects of the present invention indicates a thickness in an absolutely dry state, the thickness being defined as the average value of measurement values obtained by measuring the thicknesses at four points in a section with a scanning electron microscope. In aspects of the present invention, an object whose thickness is measured is set to a quadrangle. The four points are located at positions 1 cm from the four corners toward the center of gravity of the quadrangle.

Ink-Receiving Layer Coating Liquid

Sol Containing at Least One Compound Selected from Alumina and Hydrated Alumina

Alumina or hydrated alumina used in aspects of the present invention may be contained in a dispersion in a deflocculated state due to a deflocculant. A dispersion containing hydrated alumina deflocculated with the deflocculant is referred to as a hydrated alumina dispersion. A dispersion containing alumina deflocculated with the deflocculant is referred to as an alumina sol. A sol containing at least one compound selected from alumina and hydrated alumina may further contain an acid serving as a deflocculant. In addition, the sol may further contain an additive, for example, a dispersion medium, a pigment dispersant, a thickener, a flow improver, an antifoaming agent, a foam inhibitor, a surfactant, a release agent, a penetrant, a color pigment, a color dye, a fluorescent whitener, an ultraviolet absorber, an antioxidant, a preservative, a fungicide, a water resistant additive, a dye fixing agent, a cross-linking agent, or a weatherproofer. Examples of the dispersion medium used for the sol containing at least one compound selected from alumina and hydrated alumina include water, organic solvents, and mixed solvent thereof. In particular, water may be used. In aspects of the present invention, an acid (deflocculating acid) may be used as a deflocculant. As the deflocculating acid, a monovalent sulfonic acid may be used from the viewpoint of achieving good ozone resistance of an image and inhibiting the blurring of an image in a high-humidity environment. Specific examples of the monovalent sulfonic acid include methanesulfonic acid, ethanesulfonic acid, 1-propanesulfonic acid, 2-propanesulfonic acid, 1-butanesulfonic acid, chloromethanesulfonic acid, dichloromethanesulfonic acid, trichloromethanesulfonic acid, trifluoromethanesulfonic acid, amidosulfonic acid, taurine, vinylsulfonic acid, aminomethanesulfonic acid, 3-amino-1-propanesulfonic acid, benzenesulfonic acid, hydroxybenzenesulfonic acid, and p-toluenesulfonic acid. These compounds may be used separately or in combination as a mixture.

The sol containing at least one compound selected from alumina and hydrated alumina may have a deflocculating acid content of 100 mmol to 500 mmol with respect to 1 kg of the total weight of hydrated alumina and alumina. A deflocculating acid content of 100 mmol or more results in the inhibition of a significant increase in the viscosity of the sol. A deflocculating acid content of 500 mmol or less results in the inhibition of the occurrence of bronzing and beading without saturating the deflocculating effect.

Sol Containing Silica Produced by Vapor-Phase Process

Silica produced by a vapor-phase process used in aspects of the present invention may be added to the ink-receiving layer coating liquid in a state in which the silica is dispersed in a dispersion medium. A dispersion containing a cation polymer serving as a mordant and silica produced by a vapor-phase process is defined as a sol of silica produced by a vapor-phase process. Examples of the cationic polymer include polyethyleneimine resins, polyamine resins, polyamide resins, polyamide-epichlorohydrin resins, polyamine-epichlorohydrin resins, polyamide-polyamine-epichlorohydrin resins, polydiallylamine resins, and dicyandiamide condensates. These cationic resins may be used separately or in combination. The sol of silica produced by a vapor-phase process may contain a multivalent metal salt. Examples of the multivalent metal salt include aluminum compounds, such as poly(aluminum chloride), poly(aluminum acetate), and poly(aluminum lactate). The sol of silica produced by a vapor-phase process may further contain an additive, for example, a surface modifier, such as a silane coupling agent, a thickener, a flow improver, an antifoaming agent, a foam inhibitor, a surfactant, a release agent, a penetrant, a color pigment, a color dye, a fluorescent whitener, an ultraviolet absorber, an antioxidant, a preservative, a fungicide, a water resistant additive, a cross-linking agent, or a weatherproofer. Examples of a dispersion medium for the sol containing silica produced by a vapor-phase process include water, organic solvents, and mixed solvents thereof. In particular, water may be used.

Method for Applying Ink-Receiving Layer Coating Liquid

In aspects of the present invention, the ink-receiving layer coating liquid is applied and dried to form an ink-receiving layer. The ink-receiving layer coating liquid may be applied by a known coating method. Examples of the coating method include a slot die method, a slide bead method, a curtain method, an extrusion method, an air-knife method, a roll coating method, and a rod-bar coating method. Coating liquids used for the lower layer and the upper layer may be applied and dried by sequential coating or may be applied by simultaneous multilayer coating. In particular, simultaneous multilayer coating may be performed by the slide bead method because of its high productivity.

Drying after coating is performed by a hot-air dryer, e.g., a linear tunnel dryer, an arch dryer, an air-loop dryer, or a sine-curve air float dryer, or a dryer using infrared rays, heating, microwaves, or the like.

EXAMPLES

While the present invention will be described below in more detail by examples, the present invention is not limited to these examples. Note that the term "part(s)" indicates part(s) by mass.

Production of Water Resistant Support

A pulp containing 80 parts of laubholz bleached kraft pulp (LBKP) having a freeness of 450 mL in terms of Canadian Standard Freeness (CSF) and 20 parts of nadelholz bleached kraft pulp (NBKP) having a freeness of 480 mL in terms of CSF was prepared. Next, 0.60 parts of cationized starch, 10 parts of heavy calcium carbonate, 15 parts of precipitated calcium carbonate, 0.10 parts of alkyl ketene dimer, and 0.03 parts of cationic polyacrylamide were added to the pulp. The mixture was adjusted with water so as to have a solid content of 3.0% by mass, thereby preparing a paper material. The resulting paper material was subjected to paper making with a Fourdrinier machine, in which three-stage wet pressing was performed, followed by drying with a multi-cylinder dryer. The resulting paper was impregnated with an aqueous solution of oxidized starch so as to have a solid content of 1.0 g/m$^2$ with a size press, and then dried. The dry paper was subjected to machine calendering to provide a base paper having a basis weight of 155 g/m$^2$.

A resin composition containing low-density polyethylene (70 parts), high-density polyethylene (20 parts), and titanium oxide (10 parts) was applied to a side (front surface) of the base paper in such a manner that the resulting resin layer had a thickness of 25.0 μm, thereby forming the resin layer. Immediately after the coating of the resin layer, embossing treatment was performed using a cooling roll having a surface with regular asperities to allow the resin layer to have a semi-glossy surface. The arithmetical mean roughness (Ra), complying with JIS B0601:2001, of the surface of the resin layer at a cutoff length of 0.8 mm was 1.8 μm.

Next, a resin composition containing high-density polyethylene (50 parts) and low-density polyethylene (50 parts) was applied to on the other side (back surface) of the base paper in such a manner that the resulting resin layer had a thickness of 30.0 μm, thereby forming the resin layer.

The resin layer on the front surface was subjected to corona discharge. Then acid-treated gelatin was applied in a coating weight of 0.05 g/m$^2$ in terms of solid content, thereby forming an adhesion-improving layer. The resin layer on the back surface was also subjected to corona discharge. A matting agent containing 0.4 g of a styrene-acrylate latex binder having a glass transition temperature (Tg) of about 80° C., 0.1 g of an antistatic agent (cationic polymer), and 0.1 g of colloidal silica was applied to the back surface to form a back layer.

Thereby, the water resistant support used in the examples was produced.

Preparation of Hydrated Alumina Sol

First, 1.5 parts of methanesulfonic acid serving as a deflocculant was added to 333 parts of deionized water to prepare an aqueous solution of methanesulfonic acid. Then 100 parts of hydrated alumina (DISPERAL HP14, manufactured by Sasol) was gradually added to the aqueous solution of methanesulfonic acid under stirring at 3000 rpm with a homomixer (T.K. Homomixer MARK II Model 2.5, manufactured by Tokushu Kika Kogyo Co., Ltd). After the completion of the addition, the mixture was stirred for 30 minutes to prepare a hydrated alumina sol having a solid content of 23.0% by mass.

Preparation of Alumina Sol

First, 1.5 parts of methanesulfonic acid serving as a deflocculant was added to 333 parts of deionized water to prepare an aqueous solution of methanesulfonic acid. Then 100 parts of alumina (AEROXIDE Alu C, manufactured by EVONIK Industries) was gradually added to the aqueous solution of methanesulfonic acid under stirring at 3000 rpm with a homomixer (T.K. Homomixer MARK II Model 2.5, manufactured by Tokushu Kika Kogyo Co., Ltd). After the completion of the addition, the mixture was stirred for 30 minutes to prepare an alumina sol having a solid content of 23.0% by mass.

Preparation of Sol of Silica Produced by Vapor-Phase Process

First, 4.0 parts of a cationic polymer (Shallol DC-902P, manufactured by Dai-Ichi Kogyo Seiyaku Co., Ltd) was added to 333 parts of deionized water to prepare an aqueous solution of the cationic polymer. Then 100 parts of silica produced by a vapor-phase process (AEROSIL 300, manufactured by EVONIK Industries) was gradually added to the aqueous solution of the cationic polymer under stirring at 3000 rpm with a homomixer (T.K. Homomixer MARK II Model 2.5, manufactured by Tokushu Kika Kogyo Co., Ltd). After the completion of the addition, the mixture was diluted with deionized water and was homogenized twice with a high-pressure homogenizer (Nanomizer, manufactured by Yoshida Kikai Co., Ltd.) to prepare a sol of silica produced by a vapor-phase process, the sol having a solid content of 20.0% by mass.

Preparation of Polyvinyl Alcohol-Containing Aqueous Solution

First, 100 parts of polyvinyl alcohol (PVA 235, manufactured by Kuraray Co., Ltd., saponification degree: 88% by mole, average degree of polymerization: 3500) was added to 1150 parts of deionized water under stirring. After the completion of the addition, the polyvinyl alcohol was dissolved by heating to 90° C. to prepare a polyvinyl alcohol-containing aqueous solution having a solid content of 8.0% by mass.

Production of Recording Medium 1

Upper Layer Coating Liquid 1

The hydrated alumina sol and the alumina sol were mixed in such a manner that the ratio by mass of hydrated alumina to alumina in terms of solid content was 70:30, thereby forming a mixed sol. The polyvinyl alcohol-containing aqueous solution was added to the mixed sol in such a manner that the proportion of polyvinyl alcohol in terms of solid content was 7.0 parts with respect to 100 parts of the total solid content of hydrated alumina and alumina contained in the mixed sol, thereby forming a liquid mixture. An aqueous orthoboric acid solution having a solid content of 5.0% by mass was added thereto in such a manner that the proportion of orthoboric acid in terms of solid content was 16.4 parts with respect to 100 parts of the solid content of polyvinyl alcohol in the liquid mixture, thereby preparing an upper layer coating liquid. A surfactant (trade name: Surfynol 465, manufactured by Nissin Chemical Industry Co., Ltd.) was added thereto in such a manner that the proportion of the surfactant was 0.1% by mass with respect to the total mass of the coating liquid, thereby preparing an upper layer coating liquid 1.

Lower Layer Coating Liquid 1

The polyvinyl alcohol-containing aqueous solution was added to the hydrated alumina sol in such a manner that the proportion of polyvinyl alcohol in terms of solid content was 13.0 parts with respect to 100 parts of the solid content of hydrated alumina, thereby forming a liquid mixture. An aqueous orthoboric acid solution having a solid content of 5.0% by mass was added thereto in such a manner that the proportion of orthoboric acid in terms of solid content was 5.8 parts with respect to 100 parts of the solid content of polyvinyl alcohol in the liquid mixture, thereby preparing a lower layer coating liquid 1.

Formation of Ink-Receiving Layer

The upper layer coating liquid 1 and the lower layer coating liquid 1 were applied to the front surface of the support. The application was performed with a multilayer slide hopper coater in such a manner that in an absolutely dry state, the thickness of the lower layer was 25.0 μm, the thickness of the upper layer provided on the lower layer was 10.0 μm, and the total thickness was 35.0 μm. Subsequently, drying was performed at 60° C. to provide a recording medium 1.

Production of Recording Medium 2

A recording medium 2 was produced as in the recording medium 1, except that a lower layer coating liquid 2 described below was used in place of the lower layer coating liquid 1 for the recording medium 1.

Lower Layer Coating Liquid 2

The polyvinyl alcohol-containing aqueous solution was added to the sol of silica produced by a vapor-phase process in such a manner that the proportion of polyvinyl alcohol in terms of solid content was 30.0 parts with respect to 100 parts of the solid content of silica produced by a vapor-phase process, thereby forming a liquid mixture. An aqueous orthoboric acid solution having a solid content of 5.0% by mass was added thereto in such a manner that the proportion of orthoboric acid in terms of solid content was 5.8 parts with respect to 100 parts of the solid content of polyvinyl alcohol in the liquid mixture, thereby preparing a lower layer coating liquid 2.

Production of Recording Medium 3

A recording medium 3 was produced as in the recording medium 1, except that a lower layer coating liquid 3 described below was used in place of the lower layer coating liquid 1 for the recording medium 1.

Lower Layer Coating Liquid 3

The hydrated alumina sol and the sol of silica produced by a vapor-phase process were mixed in such a manner that the ratio of hydrated alumina to the sol of silica produced by a vapor-phase process in terms of solid content was 25:75, thereby forming a mixed sol. The polyvinyl alcohol-containing aqueous solution was added to the mixed sol in such a manner that the proportion of polyvinyl alcohol in terms of solid content was 25.0 parts with respect to 100 parts of the total solid content of hydrated alumina and silica produced by a vapor-phase process contained in the mixed sol, thereby forming a liquid mixture. An aqueous orthoboric acid solution having a solid content of 5.0% by mass was added thereto in such a manner that the proportion of orthoboric acid in terms of solid content was 5.8 parts with respect to 100 parts of the solid content of polyvinyl alcohol in the liquid mixture, thereby preparing a lower layer coating liquid 3.

Production of Recording Medium 4

A recording medium 4 was produced as in the recording medium 1, except that a lower layer coating liquid 4 described below was used in place of the lower layer coating liquid 1 for the recording medium 1.

Lower Layer Coating Liquid 4

The hydrated alumina sol and the sol of silica produced by a vapor-phase process were mixed in such a manner that the ratio of hydrated alumina to the sol of silica produced by a vapor-phase process in terms of solid content was 75:25, thereby forming a mixed sol. The polyvinyl alcohol-containing aqueous solution was added to the mixed sol in such a manner that the proportion of polyvinyl alcohol in terms of solid content was 18.0 parts with respect to 100 parts of the total solid content of hydrated alumina and silica produced by a vapor-phase process contained in the mixed sol, thereby forming a liquid mixture. An aqueous orthoboric acid solution having a solid content of 5.0% by mass was added thereto in such a manner that the proportion of orthoboric acid in terms of solid content was 5.8 parts with respect to 100 parts of the solid content of polyvinyl alcohol in the liquid mixture, thereby preparing a lower layer coating liquid 4.

Production of Recording Medium 5

A recording medium 5 was produced as in the recording medium 1, except that a lower layer coating liquid 5 described below was used in place of the lower layer coating liquid 1 for the recording medium 1.

Lower Layer Coating Liquid 5

The hydrated alumina sol and the alumina sol were mixed in such a manner that the ratio of hydrated alumina to alumina in terms of solid content was 75:25, thereby forming a mixed sol. The polyvinyl alcohol-containing aqueous solution was added to the mixed sol in such a manner that the proportion of polyvinyl alcohol in terms of solid content was 13.0 parts with respect to 100 parts of the total solid content of hydrated alumina and alumina contained in the mixed sol, thereby forming a liquid mixture. An aqueous orthoboric acid solution having a solid content of 5.0% by mass was added thereto in such a manner that the proportion of orthoboric acid in terms of solid content was 5.8 parts with respect to 100 parts of the solid content of polyvinyl alcohol in the liquid mixture, thereby preparing a lower layer coating liquid 5.

Production of Recording Medium 6

A recording medium 6 was produced as in the recording medium 1, except that a lower layer coating liquid 6 described below was used in place of the lower layer coating liquid 1 for the recording medium 1.

Lower Layer Coating Liquid 6

The hydrated alumina sol and the alumina sol were mixed in such a manner that the ratio of hydrated alumina to alumina in terms of solid content was 25:75, thereby forming a mixed sol. The polyvinyl alcohol-containing aqueous solution was added to the mixed sol in such a manner that the proportion of polyvinyl alcohol in terms of solid content was 13.0 parts with respect to 100 parts of the total solid content of hydrated alumina and alumina contained in the mixed sol, thereby forming a liquid mixture. An aqueous orthoboric acid solution having a solid content of 5.0% by mass was added thereto in such a manner that the proportion of orthoboric acid in terms of solid content was 5.8 parts with respect to 100 parts of the solid content of polyvinyl alcohol in the liquid mixture, thereby preparing a lower layer coating liquid 6.

Production of Recording Medium 7

A recording medium 7 was produced as in the recording medium 1, except that the application was performed in such a manner that the thickness of the upper layer of the recording medium 1 was 5.0 μm, the thickness of the lower layer was 13.0 μm, and the total thickness was 18.0 μm.

Production of Recording Medium 8

A recording medium 8 was produced as in the recording medium 1, except that the application was performed in such a manner that the thickness of the upper layer of the recording medium 1 was 6.0 μm, the thickness of the lower layer was 14.0 μm, and the total thickness was 20.0 μm.

Production of Recording Medium 9

A recording medium 9 was produced as in the recording medium 1, except that the application was performed in such a manner that the thickness of the upper layer of the recording medium 1 was 12.0 μm, the thickness of the lower layer was 28.0 μm, and the total thickness was 40.0 μm.

Production of Recording Medium 10

A recording medium 10 was produced as in the recording medium 1, except that the application was performed in such a manner that the thickness of the upper layer of the recording medium 1 was 13.0 μm, the thickness of the lower layer was 30.0 μm, and the total thickness was 43.0 μm.

Production of Recording Medium 11

A recording medium 11 was produced as in the recording medium 1, except that the application was performed in such a manner that the thickness of the upper layer of the recording medium 1 was 2.5 μm, the thickness of the lower layer was 32.5 μm, and the total thickness was 35.0 μm.

Production of Recording Medium 12

A recording medium 12 was produced as in the recording medium 1, except that the application was performed in such a manner that the thickness of the upper layer of the recording medium 1 was 5.0 μm, the thickness of the lower layer was 30.0 μm, and the total thickness was 35.0 μm.

Production of Recording Medium 13

A recording medium 13 was produced as in the recording medium 1, except that the application was performed in such a manner that the thickness of the upper layer of the recording medium 1 was 17.5 μm, the thickness of the lower layer was 17.5 μm, and the total thickness was 35.0 μm.

Production of Recording Medium 14

A recording medium 14 was produced as in the recording medium 1, except that the application was performed in such a manner that the thickness of the upper layer of the recording medium 1 was 20.0 μm, the thickness of the lower layer was 15.0 μm, and the total thickness was 35.0 μm.

Production of Recording Medium 15

A recording medium 15 was produced as in the recording medium 1, except that in the preparation of the upper layer coating liquid 1 for the recording medium 1, the aqueous orthoboric acid solution having a solid content of 5.0% by mass was added in such a manner that the proportion of orthoboric acid in terms of solid content was 10.0 parts with respect to 100 parts of the solid content of polyvinyl alcohol.

Production of Recording Medium 16

A recording medium 16 was produced as in the recording medium 1, except that in the preparation of the upper layer coating liquid 1 for the recording medium 1, the aqueous orthoboric acid solution having a solid content of 5.0% by mass was added in such a manner that the proportion of orthoboric acid in terms of solid content was 30.0 parts with respect to 100 parts of the solid content of polyvinyl alcohol.

Production of Recording Medium 17

A recording medium 17 was produced as in the recording medium 1, except that in the preparation of the upper layer coating liquid 1 for the recording medium 1, the polyvinyl alcohol-containing aqueous solution having a solid content of 8.0% by mass was added in such a manner that the proportion of polyvinyl alcohol in terms of solid content was 4.0 parts with respect to 100 parts of the total solid content of hydrated alumina and alumina contained in the mixed sol.

Production of Recording Medium 18

A recording medium 18 was produced as in the recording medium 1, except that in the preparation of the upper layer coating liquid 1 for the recording medium 1, the polyvinyl alcohol-containing aqueous solution having a solid content of 8.0% by mass was added in such a manner that the proportion of polyvinyl alcohol in terms of solid content was 5.0 parts with respect to 100 parts of the total solid content of hydrated alumina and alumina contained in the mixed sol.

Production of Recording Medium 19

A recording medium 19 was produced as in the recording medium 1, except that in the preparation of the upper layer coating liquid 1 for the recording medium 1, the polyvinyl alcohol-containing aqueous solution having a solid content of 8.0% by mass was added in such a manner that the proportion of polyvinyl alcohol in terms of solid content was 10.0 parts with respect to 100 parts of the total solid content of hydrated alumina and alumina contained in the mixed sol.

Production of Recording Medium 20

A recording medium 20 was produced as in the recording medium 1, except that in the preparation of the upper layer coating liquid 1 for the recording medium 1, the polyvinyl alcohol-containing aqueous solution having a solid content of 8.0% by mass was added in such a manner that the proportion of polyvinyl alcohol in terms of solid content was 11.0 parts with respect to 100 parts of the total solid content of hydrated alumina and alumina contained in the mixed sol.

Production of Recording Medium 21

A recording medium 21 was produced as in the recording medium 1, except that in the preparation of the lower layer coating liquid 1 for the recording medium 1, the aqueous orthoboric acid solution having a solid content of 5.0% by mass was added in such a manner that the proportion of orthoboric acid in terms of solid content was 2.3 parts with respect to 100 parts of the solid content of polyvinyl alcohol.

Production of Recording Medium 22

A recording medium 22 was produced as in the recording medium 1, except that in the preparation of the lower layer coating liquid 1 for the recording medium 1, the aqueous orthoboric acid solution having a solid content of 5.0% by mass was added in such a manner that the proportion of orthoboric acid in terms of solid content was 6.9 parts with respect to 100 parts of the solid content of polyvinyl alcohol.

Production of Recording Medium 23

A recording medium 23 was produced as in the recording medium 2, except that in the preparation of the lower layer coating liquid 2 for the recording medium 2, the aqueous orthoboric acid solution having a solid content of 5.0% by mass was added in such a manner that the proportion of orthoboric acid in terms of solid content was 2.3 parts with respect to 100 parts of the solid content of polyvinyl alcohol.

Production of Recording Medium 24

A recording medium 24 was produced as in the recording medium 2, except that in the preparation of the lower layer coating liquid 2 for the recording medium 2, the aqueous orthoboric acid solution having a solid content of 5.0% by mass was added in such a manner that the proportion of orthoboric acid in terms of solid content was 7.0 parts with respect to 100 parts of the solid content of polyvinyl alcohol.

Production of Recording Medium 25

A recording medium 25 was produced as in the recording medium 3, except that in the preparation of the lower layer coating liquid 3 for the recording medium 3, the aqueous orthoboric acid solution having a solid content of 5.0% by mass was added in such a manner that the proportion of orthoboric acid in terms of solid content was 2.4 parts with respect to 100 parts of the solid content of polyvinyl alcohol.

Production of Recording Medium 26

A recording medium 26 was produced as in the recording medium 3, except that in the preparation of the lower layer coating liquid 3 for the recording medium 3, the aqueous orthoboric acid solution having a solid content of 5.0% by mass was added in such a manner that the proportion of orthoboric acid in terms of solid content was 6.8 parts with respect to 100 parts of the solid content of polyvinyl alcohol.

Production of Recording Medium 27

A recording medium 27 was produced as in the recording medium 4, except that in the preparation of the lower layer coating liquid 4 for the recording medium 4, the aqueous orthoboric acid solution having a solid content of 5.0% by mass was added in such a manner that the proportion of orthoboric acid in terms of solid content was 2.2 parts with respect to 100 parts of the solid content of polyvinyl alcohol.

Production of Recording Medium 28

A recording medium 28 was produced as in the recording medium 4, except that in the preparation of the lower layer coating liquid 4 for the recording medium 4, the aqueous orthoboric acid solution having a solid content of 5.0% by mass was added in such a manner that the proportion of orthoboric acid in terms of solid content was 6.7 parts with respect to 100 parts of the solid content of polyvinyl alcohol.

Production of Recording Medium 29

A recording medium 29 was produced as in the recording medium 1, except that in the preparation of the lower layer coating liquid 1 for the recording medium 1, the polyvinyl alcohol-containing aqueous solution was added in such a manner that the proportion of polyvinyl alcohol in terms of solid content was 10.0 parts with respect to 100 parts of the solid content of hydrated alumina.

Production of Recording Medium 30

A recording medium 30 was produced as in the recording medium 1, except that in the preparation of the lower layer coating liquid 1 for the recording medium 1, the polyvinyl alcohol-containing aqueous solution was added in such a manner that the proportion of polyvinyl alcohol in terms of solid content was 11.0 parts with respect to 100 parts of the solid content of hydrated alumina.

Production of Recording Medium 31

A recording medium 31 was produced as in the recording medium 1, except that in the preparation of the lower layer coating liquid 1 for the recording medium 1, the polyvinyl alcohol-containing aqueous solution was added in such a manner that the proportion of polyvinyl alcohol in terms of solid content was 40.0 parts with respect to 100 parts of the solid content of hydrated alumina.

Production of Recording Medium 32

A recording medium 32 was produced as in the recording medium 1, except that in the preparation of the lower layer coating liquid 1 for the recording medium 1, the polyvinyl alcohol-containing aqueous solution was added in such a manner that the proportion of polyvinyl alcohol in terms of solid content was 42.0 parts with respect to 100 parts of the solid content of hydrated alumina.

Production of Recording Medium 33

A recording medium 33 was produced as in the recording medium 2, except that in the preparation of the lower layer coating liquid 2 for the recording medium 2, the polyvinyl alcohol-containing aqueous solution was added in such a manner that the proportion of polyvinyl alcohol in terms of solid content was 10.0 parts with respect to 100 parts of the solid content of silica produced by a vapor-phase process.

Production of Recording Medium 34

A recording medium 34 was produced as in the recording medium 2, except that in the preparation of the lower layer coating liquid 2 for the recording medium 2, the polyvinyl alcohol-containing aqueous solution was added in such a manner that the proportion of polyvinyl alcohol in terms of solid content was 11.0 parts with respect to 100 parts of the solid content of silica produced by a vapor-phase process.

Production of Recording Medium 35

A recording medium 35 was produced as in the recording medium 2, except that in the preparation of the lower layer coating liquid 2 for the recording medium 2, the polyvinyl alcohol-containing aqueous solution was added in such a manner that the proportion of polyvinyl alcohol in terms of solid content was 40.0 parts with respect to 100 parts of the solid content of silica produced by a vapor-phase process.

Production of Recording Medium 36

A recording medium 36 was produced as in the recording medium 2, except that in the preparation of the lower layer coating liquid 2 for the recording medium 2, the polyvinyl alcohol-containing aqueous solution was added in such a manner that the proportion of polyvinyl alcohol in terms of solid content was 42.0 parts with respect to 100 parts of the solid content of silica produced by a vapor-phase process.

Production of Recording Medium 37

A recording medium 37 was produced as in the recording medium 3, except that in the preparation of the lower layer coating liquid 3 for the recording medium 3, the polyvinyl alcohol-containing aqueous solution was added in such a manner that the proportion of polyvinyl alcohol in terms of solid content was 10.0 parts with respect to 100 parts of the total solid content of hydrated alumina and silica produced by a vapor-phase process in the mixed sol.

Production of Recording Medium 38

A recording medium 38 was produced as in the recording medium 3, except that in the preparation of the lower layer coating liquid 3 for the recording medium 3, the polyvinyl alcohol-containing aqueous solution was added in such a manner that the proportion of polyvinyl alcohol in terms of solid content was 11.0 parts with respect to 100 parts of the total solid content of hydrated alumina and silica produced by a vapor-phase process in the mixed sol.

Production of Recording Medium 39

A recording medium 39 was produced as in the recording medium 3, except that in the preparation of the lower layer coating liquid 3 for the recording medium 3, the polyvinyl alcohol-containing aqueous solution was added in such a manner that the proportion of polyvinyl alcohol in terms of solid content was 40.0 parts with respect to 100 parts of the total solid content of hydrated alumina and silica produced by a vapor-phase process in the mixed sol.

Production of Recording Medium 40

A recording medium 40 was produced as in the recording medium 3, except that in the preparation of the lower layer coating liquid 3 for the recording medium 3, the polyvinyl alcohol-containing aqueous solution was added in such a manner that the proportion of polyvinyl alcohol in terms of solid content was 42.0 parts with respect to 100 parts of the total solid content of hydrated alumina and silica produced by a vapor-phase process in the mixed sol.

Production of Recording Medium 41

A recording medium 41 was produced as in the recording medium 4, except that in the preparation of the lower layer coating liquid 4 for the recording medium 4, the polyvinyl alcohol-containing aqueous solution was added in such a manner that the proportion of polyvinyl alcohol in terms of solid content was 10.0 parts with respect to 100 parts of the total solid content of hydrated alumina and silica produced by a vapor-phase process in the mixed sol.

Production of Recording Medium 42

A recording medium 42 was produced as in the recording medium 4, except that in the preparation of the lower layer coating liquid 4 for the recording medium 4, the polyvinyl alcohol-containing aqueous solution was added in such a manner that the proportion of polyvinyl alcohol in terms of solid content was 11.0 parts with respect to 100 parts of the total solid content of hydrated alumina and silica produced by a vapor-phase process in the mixed sol.

Production of Recording Medium 43

A recording medium 43 was produced as in the recording medium 4, except that in the preparation of the lower layer coating liquid 4 for the recording medium 4, the polyvinyl alcohol-containing aqueous solution was added in such a manner that the proportion of polyvinyl alcohol in terms of solid content was 40.0 parts with respect to 100 parts of the total solid content of hydrated alumina and silica produced by a vapor-phase process in the mixed sol.

Production of Recording Medium 44

A recording medium 44 was produced as in the recording medium 4, except that in the preparation of the lower layer coating liquid 4 for the recording medium 4, the polyvinyl alcohol-containing aqueous solution was added in such a manner that the proportion of polyvinyl alcohol in terms of solid content was 42.0 parts with respect to 100 parts of the total solid content of hydrated alumina and silica produced by a vapor-phase process in the mixed sol.

Production of Recording Medium 45

A recording medium 45 was produced as in the recording medium 1, except that in the preparation of the upper layer coating liquid 1 for the recording medium 1, the ratio by mass of hydrated alumina to alumina in terms of solid content was 100:0.

Production of Recording Medium 46

A recording medium 46 was produced as in the recording medium 1, except that in the preparation of the upper layer coating liquid 1 and the lower layer coating liquid 1 for the recording medium 1, an aqueous solution of another polyvinyl alcohol (PVA 217, manufactured by Kuraray Co., Ltd., saponification degree: 88%, average degree of polymerization: 1700) (solid content: 8.0% by mass) was used in place of the polyvinyl alcohol-containing aqueous solution.

Production of Recording Medium 47

A recording medium 47 was produced as in the recording medium 1, except that in the preparation of the upper layer coating liquid 1 and the lower layer coating liquid 1 for the recording medium 1, an aqueous solution of another polyvinyl alcohol (PVA 424, manufactured by Kuraray Co., Ltd., saponification degree: 80%, average degree of polymerization: 2400) (solid content: 8.0% by mass) was used in place of the polyvinyl alcohol-containing aqueous solution.

Production of Recording Medium 48

A recording medium 48 was produced as in the recording medium 1, except that in the preparation of the upper layer coating liquid 1 and the lower layer coating liquid 1 for the recording medium 1, a mixed aqueous solution in which the ratio of orthoboric acid to borax in terms of solid content was 75:25 and which had a total solid content of 5.0% by mass was used in place of the aqueous orthoboric acid solution having a solid content of 5.0% by mass.

Production of Recording Medium 49

A recording medium 49 was produced as in the recording medium 1, except that in the production of the support for the recording medium 1, in place of the cooling roll, a cooling roll having a surface without asperities was used in the embossing treatment.

Production of Recording Medium 50

A recording medium 50 was produced as in the recording medium 1, except that in the production of the support for the recording medium 1, in place of the cooling roll, a cooling roll having a surface with larger asperities was used in the embossing treatment.

Production of Recording Medium 51

A recording medium 51 was produced as in the recording medium 1, except that in the formation of the ink-receiving layer for the recording medium 1, only the upper layer having a thickness of 35.0 μm was formed by coating in such a manner that the ink-receiving layer had a single-layer structure.

Production of Recording Medium 52

A recording medium 52 was produced as in the recording medium 1, except that in the formation of the ink-receiving layer for the recording medium 1, only the lower layer having a thickness of 35.0 μm was formed by coating in such a manner that the ink-receiving layer had a single-layer structure.

Production of Recording Medium 53

A recording medium 53 was produced as in the recording medium 2, except that in the formation of the ink-receiving layer for the recording medium 2, only the lower layer having a thickness of 35.0 μm was formed by coating in such a manner that the ink-receiving layer had a single-layer structure.

Production of Recording Medium 54

A recording medium 54 was produced as in the recording medium 3, except that in the formation of the ink-receiving layer for the recording medium 3, only the lower layer having a thickness of 35.0 μm was formed by coating in such a manner that the ink-receiving layer had a single-layer structure.

Production of Recording Medium 55

A recording medium 55 was produced as in the recording medium 4, except that in the formation of the ink-receiving layer for the recording medium 4, only the lower layer having a thickness of 35.0 μm was formed by coating in such a manner that the ink-receiving layer had a single-layer structure.

Production of Recording Medium 56

A recording medium 56 was produced as in the recording medium 1, except that in the formation of the ink-receiving layer for the recording medium 1, the upper layer coating liquid 1 and the lower layer coating liquid were interchanged.

Production of Recording Medium 57

A recording medium 57 was produced as in the recording medium 1, except that in the formation of the ink-receiving layer for the recording medium 1, the aqueous orthoboric acid solution was not added to the upper layer coating liquid 1 or the lower layer coating liquid 1.

Production of Recording Medium 58

A recording medium 58 was produced as in the recording medium 1, except that in the formation of the ink-receiving layer for the recording medium 1, the aqueous orthoboric acid solution was not added to the lower layer coating liquid 1.

Production of Recording Medium 59

A recording medium 59 was produced as in the recording medium 1, except that in the formation of the ink-receiving layer for the recording medium 1, the aqueous orthoboric acid solution was not added to the upper layer coating liquid 1.

Production of Recording Medium 60

A recording medium 60 was produced as in the recording medium 1, except that in the preparation of the upper layer coating liquid 1 for the recording medium 1, the aqueous orthoboric acid solution having a solid content of 5.0% by mass was added in such a manner that the proportion of orthoboric acid in terms of solid content was 35.7 parts with respect to 100 parts of the solid content of polyvinyl alcohol.

Production of Recording Medium 61

A recording medium 61 was produced as in the recording medium 1, except that in the preparation of the upper layer coating liquid 1 for the recording medium 1, the aqueous orthoboric acid solution having a solid content of 5.0% by mass was added in such a manner that the proportion of orthoboric acid in terms of solid content was 9.3 parts with respect to 100 parts of the solid content of polyvinyl alcohol.

Production of Recording Medium 62

A recording medium 62 was produced as in the recording medium 1, except that in the preparation of the lower layer coating liquid 1 for the recording medium 1, the aqueous orthoboric acid solution having a solid content of 5.0% by mass was added in such a manner that the proportion of orthoboric acid in terms of solid content was 1.5 parts with respect to 100 parts of the solid content of polyvinyl alcohol.

Production of Recording Medium 63

A recording medium 63 was produced as in the recording medium 1, except that in the preparation of the lower layer coating liquid 1 for the recording medium 1, the aqueous orthoboric acid solution having a solid content of 5.0% by mass was added in such a manner that the proportion of orthoboric acid in terms of solid content was 7.7 parts with respect to 100 parts of the solid content of polyvinyl alcohol.

Production of Recording Medium 64

A recording medium 64 was produced as in the recording medium 2, except that in the preparation of the lower layer coating liquid 2 for the recording medium 2, the aqueous orthoboric acid solution having a solid content of 5.0% by mass was added in such a manner that the proportion of orthoboric acid in terms of solid content was 1.7 parts with respect to 100 parts of the solid content of polyvinyl alcohol.

Production of Recording Medium 65

A recording medium 65 was produced as in the recording medium 2, except that in the preparation of the lower layer coating liquid 2 for the recording medium 2, the aqueous orthoboric acid solution having a solid content of 5.0% by mass was added in such a manner that the proportion of orthoboric acid in terms of solid content was 7.7 parts with respect to 100 parts of the solid content of polyvinyl alcohol.

Production of Recording Medium 66

A recording medium 66 was produced as in the recording medium 3, except that in the preparation of the lower layer coating liquid 3 for the recording medium 3, the aqueous orthoboric acid solution having a solid content of 5.0% by mass was added in such a manner that the proportion of orthoboric acid in terms of solid content was 1.6 parts with respect to 100 parts of the solid content of polyvinyl alcohol.

Production of Recording Medium 67

A recording medium 67 was produced as in the recording medium 3, except that in the preparation of the lower layer coating liquid 3 for the recording medium 3, the aqueous orthoboric acid solution having a solid content of 5.0% by mass was added in such a manner that the proportion of orthoboric acid in terms of solid content was 7.6 parts with respect to 100 parts of the solid content of polyvinyl alcohol.

Production of Recording Medium 68

A recording medium 68 was produced as in the recording medium 4, except that in the preparation of the lower layer coating liquid 4 for the recording medium 4, the aqueous orthoboric acid solution having a solid content of 5.0% by mass was added in such a manner that the proportion of orthoboric acid in terms of solid content was 1.7 parts with respect to 100 parts of the solid content of polyvinyl alcohol.

Production of Recording Medium 69

A recording medium 69 was produced as in the recording medium 4, except that in the preparation of the lower layer coating liquid 4 for the recording medium 4, the aqueous orthoboric acid solution having a solid content of 5.0% by mass was added in such a manner that the proportion of orthoboric acid in terms of solid content was 7.8 parts with respect to 100 parts of the solid content of polyvinyl alcohol.

Production of Recording Medium 70

Upper Layer Coating Liquid 2

The polyvinyl alcohol-containing aqueous solution was added in such a manner that the proportion of polyvinyl alcohol in terms of solid content was 6.8 parts with respect to 100 parts of the solid content of the hydrated alumina sol, thereby preparing a liquid mixture. An aqueous orthoboric acid solution having a solid content of 5.0% by mass was added thereto in such a manner that the proportion of orthoboric acid in terms of solid content was 17.7 parts with respect to 100 parts of the solid content of polyvinyl alcohol in the liquid mixture, thereby preparing an upper layer coating liquid. A surfactant (trade name: Surfynol 465, manufactured by Nissin Chemical Industry Co., Ltd.) was added thereto in such a manner that the proportion of the surfactant was 0.1% by mass with respect to the total mass of the coating liquid, thereby preparing an upper layer coating liquid 2.

Lower Layer Coating Liquid 7

The polyvinyl alcohol-containing aqueous solution was added to the hydrated alumina sol in such a manner that the proportion of polyvinyl alcohol in terms of solid content was 15.0 parts with respect to 100 parts of the solid content of hydrated alumina, thereby forming a liquid mixture. An aqueous orthoboric acid solution having a solid content of 5.0% by mass was added thereto in such a manner that the proportion of orthoboric acid in terms of solid content was 8.0 parts with respect to 100 parts of the solid content of polyvinyl alcohol in the liquid mixture, thereby preparing a lower layer coating liquid 7.

Formation of Ink-Receiving Layer

The upper layer coating liquid 2 and the lower layer coating liquid 7 were applied to the front surface of the support with a multilayer slide hopper coater to form one lower layer and one upper layer on the lower layer. That is, two layers were formed in total. In this case, the application was performed in such a manner that in an absolutely dry state, the thickness of the lower layer was 20.0 μm, the thickness of the upper layer was 20.0 μm, and the total thickness was 40.0 μm. Subsequently, drying was performed at 60° C. to provide a recording medium 70.

Compositions of the recording media 1 to 70 are described in Tables 1 and 2. Note that the surface roughness in Tables 1 and 2 indicates the surface roughness of a surface of each recording medium. The surface roughness was measured with a surface roughness tester (trade name: Surfcorder SE3500, manufactured by Kosaka Laboratory Ltd.) according to JIS B 0601:2001. The cutoff length was set to 0.8 mm. The evaluation length was set to 2.5 mm.

TABLE 1

| | Upper layer | | | Lower layer | | | Entire layer | | |
|---|---|---|---|---|---|---|---|---|---|
| | Polyvinyl alcohol | | | Polyvinyl alcohol | | | | | |
| Recording medium | content with respect to inorganic fine particles (% by mass) | Boric acid content with respect to polyvinyl alcohol (% by mass) | Thickness (μm) | content with respect to inorganic fine particles (% by mass) | Boric acid content with respect to polyvinyl alcohol (% by mass) | Thickness (μm) | Thickness (μm) | Thickness ratio of upper layer to lower layer | Surface roughness (μm) |
| 1 | 7.0 | 16.4 | 10.0 | 13.0 | 5.8 | 25.0 | 35.0 | 0.40 | 1.2 |
| 2 | 7.0 | 16.4 | 10.0 | 30.0 | 5.8 | 25.0 | 35.0 | 0.40 | 1.2 |
| 3 | 7.0 | 16.4 | 10.0 | 25.0 | 5.8 | 25.0 | 35.0 | 0.40 | 1.2 |
| 4 | 7.0 | 16.4 | 10.0 | 18.0 | 5.8 | 25.0 | 35.0 | 0.40 | 1.2 |
| 5 | 7.0 | 16.4 | 10.0 | 13.0 | 5.8 | 25.0 | 35.0 | 0.40 | 1.2 |
| 6 | 7.0 | 16.4 | 10.0 | 13.0 | 5.8 | 25.0 | 35.0 | 0.40 | 1.2 |
| 7 | 7.0 | 16.4 | 5.0 | 13.0 | 5.8 | 13.0 | 18.0 | 0.38 | 1.3 |
| 8 | 7.0 | 16.4 | 6.0 | 13.0 | 5.8 | 14.0 | 20.0 | 0.43 | 1.3 |
| 9 | 7.0 | 16.4 | 12.0 | 13.0 | 5.8 | 28.0 | 40.0 | 0.43 | 1.2 |
| 10 | 7.0 | 16.4 | 13.0 | 13.0 | 5.8 | 30.0 | 43.0 | 0.43 | 1.1 |
| 11 | 7.0 | 16.4 | 2.5 | 13.0 | 5.8 | 32.5 | 35.0 | 0.08 | 1.2 |
| 12 | 7.0 | 16.4 | 5.0 | 13.0 | 5.8 | 30.0 | 35.0 | 0.17 | 1.2 |
| 13 | 7.0 | 16.4 | 17.5 | 13.0 | 5.8 | 17.5 | 35.0 | 1.00 | 1.2 |
| 14 | 7.0 | 16.4 | 20.0 | 13.0 | 5.8 | 15.0 | 35.0 | 1.33 | 1.2 |
| 15 | 7.0 | 10.0 | 10.0 | 13.0 | 5.8 | 25.0 | 35.0 | 0.40 | 1.2 |
| 16 | 7.0 | 30.0 | 10.0 | 13.0 | 5.8 | 25.0 | 35.0 | 0.40 | 1.1 |
| 17 | 4.0 | 16.4 | 10.0 | 13.0 | 5.8 | 25.0 | 35.0 | 0.40 | 1.2 |
| 18 | 5.0 | 16.4 | 10.0 | 13.0 | 5.8 | 25.0 | 35.0 | 0.40 | 1.2 |
| 19 | 10.0 | 16.4 | 10.0 | 13.0 | 5.8 | 25.0 | 35.0 | 0.40 | 1.2 |
| 20 | 11.0 | 16.4 | 10.0 | 13.0 | 5.8 | 25.0 | 35.0 | 0.40 | 1.2 |
| 21 | 7.0 | 16.4 | 10.0 | 13.0 | 2.3 | 25.0 | 35.0 | 0.40 | 1.2 |
| 22 | 7.0 | 16.4 | 10.0 | 13.0 | 6.9 | 25.0 | 35.0 | 0.40 | 1.2 |
| 23 | 7.0 | 16.4 | 10.0 | 30.0 | 2.3 | 25.0 | 35.0 | 0.40 | 1.0 |
| 24 | 7.0 | 16.4 | 10.0 | 30.0 | 7.0 | 25.0 | 35.0 | 0.40 | 1.2 |
| 25 | 7.0 | 16.4 | 10.0 | 25.0 | 2.4 | 25.0 | 35.0 | 0.40 | 1.1 |
| 26 | 7.0 | 16.4 | 10.0 | 25.0 | 6.8 | 25.0 | 35.0 | 0.40 | 1.2 |
| 27 | 7.0 | 16.4 | 10.0 | 18.0 | 2.2 | 25.0 | 35.0 | 0.40 | 1.2 |
| 28 | 7.0 | 16.4 | 10.0 | 18.0 | 6.7 | 25.0 | 35.0 | 0.40 | 1.2 |
| 29 | 7.0 | 16.4 | 10.0 | 10.0 | 5.8 | 25.0 | 35.0 | 0.40 | 1.2 |
| 30 | 7.0 | 16.4 | 10.0 | 11.0 | 5.8 | 25.0 | 35.0 | 0.40 | 1.2 |
| 31 | 7.0 | 16.4 | 10.0 | 40.0 | 5.8 | 25.0 | 35.0 | 0.40 | 1.2 |
| 32 | 7.0 | 16.4 | 10.0 | 42.0 | 5.8 | 25.0 | 35.0 | 0.40 | 1.1 |
| 33 | 7.0 | 16.4 | 10.0 | 10.0 | 5.8 | 25.0 | 35.0 | 0.40 | 1.2 |
| 34 | 7.0 | 16.4 | 10.0 | 11.0 | 5.8 | 25.0 | 35.0 | 0.40 | 1.2 |
| 35 | 7.0 | 16.4 | 10.0 | 40.0 | 5.8 | 25.0 | 35.0 | 0.40 | 1.1 |
| 36 | 7.0 | 16.4 | 10.0 | 42.0 | 5.8 | 25.0 | 35.0 | 0.40 | 1.2 |
| 37 | 7.0 | 16.4 | 10.0 | 10.0 | 5.8 | 25.0 | 35.0 | 0.40 | 1.2 |
| 38 | 7.0 | 16.4 | 10.0 | 11.0 | 5.8 | 25.0 | 35.0 | 0.40 | 1.2 |
| 39 | 7.0 | 16.4 | 10.0 | 40.0 | 5.8 | 25.0 | 35.0 | 0.40 | 1.2 |
| 40 | 7.0 | 16.4 | 10.0 | 42.0 | 5.8 | 25.0 | 35.0 | 0.40 | 1.3 |
| 41 | 7.0 | 16.4 | 10.0 | 10.0 | 5.8 | 25.0 | 35.0 | 0.40 | 1.2 |
| 42 | 7.0 | 16.4 | 10.0 | 11.0 | 5.8 | 25.0 | 35.0 | 0.40 | 1.0 |
| 43 | 7.0 | 16.4 | 10.0 | 40.0 | 5.8 | 25.0 | 35.0 | 0.40 | 1.2 |
| 44 | 7.0 | 16.4 | 10.0 | 42.0 | 5.8 | 25.0 | 35.0 | 0.40 | 1.2 |
| 45 | 7.0 | 16.4 | 10.0 | 13.0 | 5.8 | 25.0 | 35.0 | 0.40 | 1.2 |
| 46 | 7.0 | 16.4 | 10.0 | 13.0 | 5.8 | 25.0 | 35.0 | 0.40 | 1.1 |
| 47 | 7.0 | 16.4 | 10.0 | 13.0 | 5.8 | 25.0 | 35.0 | 0.40 | 1.0 |
| 48 | 7.0 | 16.4 | 10.0 | 13.0 | 5.8 | 25.0 | 35.0 | 0.40 | 1.0 |

TABLE 1-continued

| Recording medium | Upper layer: Polyvinyl alcohol content with respect to inorganic fine particles (% by mass) | Upper layer: Boric acid content with respect to polyvinyl alcohol (% by mass) | Upper layer: Thickness (μm) | Lower layer: Polyvinyl alcohol content with respect to inorganic fine particles (% by mass) | Lower layer: Boric acid content with respect to polyvinyl alcohol (% by mass) | Lower layer: Thickness (μm) | Entire layer: Thickness (μm) | Entire layer: Thickness ratio of upper layer to lower layer | Entire layer: Surface roughness (μm) |
|---|---|---|---|---|---|---|---|---|---|
| 49 | 7.0 | 16.4 | 10.0 | 13.0 | 5.8 | 25.0 | 35.0 | 0.40 | 0.0 |
| 50 | 7.0 | 16.4 | 10.0 | 13.0 | 5.8 | 25.0 | 35.0 | 0.40 | 6.4 |

TABLE 2

| Recording medium | Upper layer: Polyvinyl alcohol content with respect to inorganic fine particles (% by mass) | Upper layer: Boric acid content with respect to polyvinyl alcohol (% by mass) | Upper layer: Thickness (μm) | Lower layer: Polyvinyl alcohol content with respect to inorganic fine particles (% by mass) | Lower layer: Boric acid content with respect to polyvinyl alcohol (% by mass) | Lower layer: Thickness (μm) | Entire layer: Thickness (μm) | Entire layer: Thickness ratio of upper layer to lower layer | Entire layer: Surface roughness (μm) |
|---|---|---|---|---|---|---|---|---|---|
| 51 | 7.0 | 16.4 | 35.0 | — | — | — | 35.0 | — | 1.2 |
| 52 | — | — | — | 13.0 | 5.8 | 35.0 | 35.0 | — | 1.2 |
| 53 | — | — | — | 30.0 | 5.8 | 35.0 | 35.0 | — | 1.2 |
| 54 | — | — | — | 25.0 | 5.8 | 35.0 | 35.0 | — | 1.2 |
| 55 | — | — | — | 18.0 | 5.8 | 35.0 | 35.0 | — | 1.1 |
| 56 | 13.0 | 5.8 | 10.0 | 7.0 | 16.4 | 25.0 | 35.0 | 0.40 | 1.2 |
| 57 | 7.0 | zero | 10.0 | 13.0 | zero | 25.0 | 35.0 | 0.40 | 1.2 |
| 58 | 7.0 | 16.4 | 10.0 | 13.0 | zero | 25.0 | 35.0 | 0.40 | 1.0 |
| 59 | 7.0 | 0.0 | 10.0 | 13.0 | 5.8 | 25.0 | 35.0 | 0.40 | 1.2 |
| 60 | 7.0 | 35.7 | 10.0 | 13.0 | 5.8 | 25.0 | 35.0 | 0.40 | 1.2 |
| 61 | 7.0 | 9.3 | 10.0 | 13.0 | 5.8 | 25.0 | 35.0 | 0.40 | 1.0 |
| 62 | 7.0 | 16.4 | 10.0 | 13.0 | 1.5 | 25.0 | 35.0 | 0.40 | 1.2 |
| 63 | 7.0 | 16.4 | 10.0 | 13.0 | 7.7 | 25.0 | 35.0 | 0.40 | 1.3 |
| 64 | 7.0 | 16.4 | 10.0 | 30.0 | 1.7 | 25.0 | 35.0 | 0.40 | 1.2 |
| 65 | 7.0 | 16.4 | 10.0 | 30.0 | 7.7 | 25.0 | 35.0 | 0.40 | 1.2 |
| 66 | 7.0 | 16.4 | 10.0 | 25.0 | 1.6 | 25.0 | 35.0 | 0.40 | 1.1 |
| 67 | 7.0 | 16.4 | 10.0 | 25.0 | 7.6 | 25.0 | 35.0 | 0.40 | 1.0 |
| 68 | 7.0 | 16.4 | 10.0 | 18.0 | 1.7 | 25.0 | 35.0 | 0.40 | 1.2 |
| 69 | 7.0 | 16.4 | 10.0 | 18.0 | 7.8 | 25.0 | 35.0 | 0.40 | 1.2 |
| 70 | 6.8 | 17.7 | 20.0 | 15.0 | 8.0 | 20.0 | 40.0 | 1.00 | 1.2 |

Evaluation

Cracking After Coating

Surfaces of the ink-receiving layers of the resulting recording media were observed and evaluated on the basis of the following criteria. The evaluation results were described in Tables 3 and 4.

Evaluation Criteria

5: No crack is observed.

4: Tiny cracks invisible to the naked eye are observed.

3: Cracks visible to the naked eye are observed in some areas.

2: Many cracks visible to the naked eye are observed in the entire surface.

1: Numerous large cracks are observed, and the ink-receiving layer is partially detached from the support.

Resistance to Cracking by Folding

Each of the resulting recording media was formed into an A4-size sheet. A solid black image was formed on the entire recording surface with an inkjet printer (trade name: MP990, manufactured by CANON KABUSHIKI KAISHA). The printed recording medium was folded in the middle in such a manner that the printed surface was inwardly folded. A load of 500 kg was applied to the recording medium with a press for 5 minutes to make a crease. Opening and closing of the creased recording medium was performed 20 times. The creased portion was visually checked and evaluated on the basis of the following criteria.

Evaluation Criteria

5: No white streak is seen.

4: A white streak is slightly seen.

3: A white streak is somewhat seen.

2: A white streak is clearly seen.

1: A wide white streak is clearly seen.

Ink Absorbency

A solid green image was formed on the recording surface of each of the resulting recording media with an inkjet printer (trade name: MP990, manufactured by CANON KABUSHIKI KAISHA, print mode: Canon Photo Paper Gloss gold, no color correction). The printed portion was visually observed and evaluated on the basis of the following criteria.

Evaluation Criteria

5: The solid image has substantially no uneven portion.

4: The solid image has only a few uneven portions.

3: The solid image has few uneven portions.

2: The solid image has many uneven portions.

1: Ink overflows on the solid image.

Image Density

A solid black image was formed on the recording surface of each of the resulting recording media with an inkjet printer (trade name: MP990, manufactured by CANON KABUSHIKI KAISHA, print mode: Canon Photo Paper Gloss gold, no color correction). The optical density of the solid image was measured with an optical reflection densitometer (trade name: 530 spectrodensitometer, manufactured by X-Rite).

Evaluation Criteria

5: 2.20 or more

4: 2.15 or more and less than 2.20

3: 2.10 or more and less than 2.15

2: 2.00 or more and less than 2.10

1: less than 2.00

The foregoing evaluation results are described in Tables 3 and 4.

TABLE 3

| | Recording medium | Evaluation | | | |
|---|---|---|---|---|---|
| | | Cracking after coating | Resistance to cracking by folding | Ink ab-sorbency | Image density |
| Example 1 | 1 | 5 | 5 | 5 | 5 |
| Example 2 | 2 | 5 | 4 | 5 | 4 |
| Example 3 | 3 | 5 | 4 | 5 | 4 |
| Example 4 | 4 | 5 | 4 | 5 | 4 |
| Example 5 | 5 | 5 | 4 | 5 | 4 |
| Example 6 | 6 | 5 | 4 | 5 | 4 |
| Example 7 | 7 | 5 | 5 | 3 | 3 |
| Example 8 | 8 | 5 | 5 | 4 | 4 |
| Example 9 | 9 | 4 | 4 | 5 | 5 |
| Example 10 | 10 | 3 | 3 | 5 | 5 |
| Example 11 | 11 | 5 | 5 | 3 | 4 |
| Example 12 | 12 | 5 | 5 | 4 | 4 |
| Example 13 | 13 | 5 | 4 | 5 | 5 |
| Example 14 | 14 | 4 | 3 | 5 | 5 |
| Example 15 | 15 | 4 | 5 | 3 | 5 |
| Example 16 | 16 | 5 | 3 | 5 | 5 |
| Example 17 | 17 | 3 | 3 | 5 | 5 |

TABLE 3-continued

| | Recording medium | Evaluation | | | |
|---|---|---|---|---|---|
| | | Cracking after coating | Resistance to cracking by folding | Ink ab-sorbency | Image density |
| Example 18 | 18 | 4 | 4 | 5 | 5 |
| Example 19 | 19 | 5 | 5 | 4 | 5 |
| Example 20 | 20 | 5 | 5 | 3 | 4 |
| Example 21 | 21 | 3 | 5 | 4 | 5 |
| Example 22 | 22 | 5 | 3 | 5 | 5 |
| Example 23 | 23 | 3 | 4 | 3 | 4 |
| Example 24 | 24 | 5 | 3 | 4 | 4 |
| Example 25 | 25 | 3 | 4 | 3 | 4 |
| Example 26 | 26 | 5 | 3 | 4 | 4 |
| Example 27 | 27 | 3 | 4 | 4 | 4 |
| Example 28 | 28 | 5 | 3 | 5 | 4 |
| Example 29 | 29 | 3 | 3 | 5 | 5 |
| Example 30 | 30 | 4 | 4 | 5 | 5 |
| Example 31 | 31 | 5 | 5 | 4 | 5 |
| Example 32 | 32 | 5 | 5 | 3 | 4 |
| Example 33 | 33 | 3 | 3 | 4 | 4 |
| Example 34 | 34 | 4 | 4 | 5 | 4 |
| Example 35 | 35 | 5 | 5 | 4 | 4 |
| Example 36 | 36 | 5 | 5 | 3 | 4 |
| Example 37 | 37 | 3 | 3 | 5 | 4 |
| Example 38 | 38 | 4 | 4 | 5 | 4 |
| Example 39 | 39 | 5 | 5 | 4 | 4 |
| Example 40 | 40 | 5 | 5 | 3 | 3 |
| Example 41 | 41 | 3 | 3 | 5 | 4 |
| Example 42 | 42 | 4 | 4 | 5 | 4 |
| Example 43 | 43 | 5 | 5 | 4 | 4 |
| Example 44 | 44 | 5 | 5 | 3 | 3 |
| Example 45 | 45 | 5 | 5 | 3 | 4 |
| Example 46 | 46 | 3 | 3 | 5 | 5 |
| Example 47 | 47 | 3 | 3 | 5 | 4 |
| Example 48 | 48 | 5 | 3 | 5 | 4 |
| Example 49 | 49 | 5 | 4 | 5 | 5 |
| Example 50 | 50 | 3 | 4 | 5 | 5 |

TABLE 4

| | Recording medium | Evaluation | | | |
|---|---|---|---|---|---|
| | | Cracking after coating | Resistance to cracking by folding | Ink absorbency | Image density |
| Comparative Example 1 | 51 | 1 | 1 | 5 | 5 |
| Comparative Example 2 | 52 | 5 | 5 | 2 | 2 |
| Comparative Example 3 | 53 | 5 | 4 | 1 | 2 |
| Comparative Example 4 | 54 | 5 | 4 | 1 | 1 |
| Comparative Example 5 | 55 | 5 | 4 | 2 | 2 |
| Comparative Example 6 | 56 | 5 | 1 | 1 | 2 |
| Comparative Example 7 | 57 | 1 | 2 | 1 | 3 |
| Comparative Example 8 | 58 | 1 | 2 | 2 | 3 |
| Comparative Example 9 | 59 | 2 | 2 | 2 | 3 |
| Comparative Example 10 | 60 | 5 | 2 | 5 | 5 |
| Comparative Example 11 | 61 | 3 | 5 | 2 | 4 |
| Comparative Example 12 | 62 | 2 | 2 | 2 | 4 |
| Comparative Example 13 | 63 | 5 | 2 | 5 | 5 |
| Comparative Example 14 | 64 | 1 | 2 | 3 | 3 |
| Comparative Example 15 | 65 | 5 | 1 | 5 | 4 |
| Comparative Example 16 | 66 | 2 | 2 | 3 | 3 |
| Comparative Example 17 | 67 | 5 | 1 | 5 | 4 |
| Comparative Example 18 | 68 | 2 | 2 | 3 | 4 |
| Comparative Example 19 | 69 | 5 | 1 | 5 | 4 |
| Comparative Example 20 | 70 | 5 | 2 | 5 | 5 |

As described in Tables 3 and 4, in each of the recording media of Examples 1 to 50, all of the resistance to cracking after coating, the resistance to cracking by folding, and the ink absorbency were satisfactory. In each of the recording media of Comparative Examples 1 to 5 in which each of the ink-receiving layers had a single-layer structure, at least one of the resistance to cracking after coating, the resistance to cracking by folding, and the ink absorbency was not satisfactory. In the recording medium of Comparative Example 6 in which the upper layer had a low boric acid content and the lower layer had a high boric acid content, in particular, the resistance to cracking by folding and the ink absorbency were not satisfactory. In each of the recording media of Comparative Examples 7 and 8 in which each lower layer did not contain boric acid, in particular, the resistance to cracking after coating was not satisfactory. In the recording medium of Comparative Example 9 in which the upper layer did not contain boric acid, all of the resistance to cracking after coating, the resistance to cracking by folding, and the ink absorbency were unsatisfactory. In the recording medium of Comparative Example 10 in which the upper layer had a high boric acid content, the resistance to cracking by folding was not satisfactory. In the recording medium of Comparative Example 11 in which the upper layer had a low boric acid content, the ink absorbency was not satisfactory. In each of the recording media of Comparative Examples 12, 14, 16, and 18 in which each of the lower layers had a low boric acid content, the resistance to cracking after coating and the resistance to cracking by folding were not satisfactory. In each of the recording media of Comparative Examples 13, 15, 17, 19, and 20 in which each of the lower layers had a high boric acid content, the resistance to cracking by folding was not satisfactory.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-027543 filed Feb. 10, 2011, which is hereby incorporated by reference herein in its entirety.

What is claimed is:

1. A recording medium comprising:

a support; and an ink-receiving layer provided on the support, the ink-receiving layer having a lower layer and an upper layer, wherein the lower layer contains fine inorganic particles, polyvinyl alcohol, and boric acid, the fine inorganic particles comprising at least one compound selected from alumina, hydrated alumina, and vapor-phase-process silica, wherein the upper layer contains fine inorganic particles, polyvinyl alcohol, and boric acid, the fine inorganic particles comprising at least one compound selected from alumina and hydrated alumina, wherein the lower layer has a boric acid content of 2.0% by mass to 7.0% by mass with respect to polyvinyl alcohol, and wherein the upper layer has a boric acid content of 10.0% by mass to 30.0% by mass with respect to polyvinyl alcohol, wherein the lower layer has a polyvinyl alcohol content of 11.0% by mass to 40.0% by mass with respect to the fine inorganic particles.

2. The recording medium according to claim 1, wherein the support is a water resistant support.

3. The recording medium according to claim 2, wherein the upper layer has a polyvinyl alcohol content of 5.0% by mass to 10.0% by mass with respect to the fine inorganic particles.

4. The recording medium according to claim 2, wherein the ink-receiving layer has a thickness of 30.0 μm to 38.0 μm.

5. The recording medium according to claim 4, wherein the upper layer has a thickness of 7.0 μm to 15.0 μm.

6. The recording medium according to claim 2, wherein the lower layer has a polyvinyl alcohol content of 12.0% by mass to 30.0% by mass with respect to the fine inorganic particles, and wherein the upper layer has a polyvinyl alcohol content of 6.0% by mass to 9.0% by mass with respect to the fine inorganic particles.

7. The recording medium according to claim 2, wherein the upper layer contains alumina and hydrated alumina serving as the fine inorganic particles, and wherein the ratio of the alumina content of the upper layer to the hydrated alumina content of the upper layer is 60:40 to 80:20.

* * * * *